US008419572B1

(12) United States Patent
Hall et al.

(10) Patent No.: US 8,419,572 B1
(45) Date of Patent: Apr. 16, 2013

(54) TRAINING TOOL AND METHOD FOR BALL HANDLING

(75) Inventors: Matthew Hall, Merritt Island, FL (US); James T. Smith, Cocoa Beach, FL (US)

(73) Assignee: Innocept, LLC, Merritt Island, FL (US)

( * ) Notice: Subject to any disclaimer, the term of this patent is extended or adjusted under 35 U.S.C. 154(b) by 91 days.

(21) Appl. No.: 13/035,646

(22) Filed: Feb. 25, 2011

(51) Int. Cl.
*A63B 69/00* (2006.01)

(52) U.S. Cl.
USPC ..... 473/424; 473/422; 473/438; 473/450

(58) Field of Classification Search ..... 473/422, 473/450, 458, 464, 423–425, 438, 446
See application file for complete search history.

(56) References Cited

U.S. PATENT DOCUMENTS

| | | | | | |
|---|---|---|---|---|---|
| 1,915,868 | A | * | 6/1933 | Rogers | 446/247 |
| 3,042,404 | A | | 7/1962 | Masters | |
| 3,227,450 | A | | 1/1966 | Pruitt | |
| 3,376,037 | A | * | 4/1968 | Lepselter | 473/425 |
| 3,450,407 | A | | 6/1969 | Russo | |
| 3,731,925 | A | * | 5/1973 | Caldwell | 473/424 |
| 3,804,409 | A | | 4/1974 | Schachner | |
| 3,940,133 | A | | 2/1976 | Civita | |
| 4,032,145 | A | * | 6/1977 | Tami | 473/424 |
| 4,145,046 | A | * | 3/1979 | Jones | 473/424 |
| 4,846,472 | A | * | 7/1989 | Terza | 473/424 |
| 5,261,661 | A | | 11/1993 | Lemmon | |
| 5,709,619 | A | * | 1/1998 | D'Emidio | 473/424 |
| 7,297,077 | B1 | * | 11/2007 | Battaglino | 473/457 |
| 7,435,193 | B2 | * | 10/2008 | Johnson et al. | 473/423 |
| 7,691,013 | B2 | * | 4/2010 | Emerson | 473/459 |

OTHER PUBLICATIONS

Fisher Tug-A-Ball Football Trainer, Football America, retrieved from http://www.footballamerica.com/catalog/product.jsp?productStyleNumber=TAB100, retrieved on Feb. 23, 2011.

* cited by examiner

*Primary Examiner* — Mitra Aryanpour
(74) *Attorney, Agent, or Firm* — Brian S. Steinberger; Law Offices of Brian S. Steinberger, P.A.

(57) ABSTRACT

Tools, devices, apparatus, systems and methods to enhance ball handling skills and reduce and eliminate fumbling of balls, from football players, basketball players and the like. The training tool can be used to improve ball security for football players of every level to reduce or even eliminate fumbling. The tool can simulate the forces imparted on a football that can cause a fumble during the game. Used during various drills in practice, the invention will improve the player's ability to maintain possession of the football during actual game play. The invention assembly can include a ball (such as a football, basketball or rugby ball), a rope, and a reciprocating handle weight subassembly. The tools can use a slightly vertical handheld sliding reciprocating weight with or without a spring(s), or motor, in order to cause shockwaves that pass to a player carrying a ball to simulate a fumbling condition during a game, where other players are trying to slap or grab or push or jar loose a ball from the grasp of the ball carrier. The reciprocating weight can be quickly pumped and/or jerked by the trainer/coach during drills to surprise and replicate a fumbling condition.

13 Claims, 14 Drawing Sheets

2
2
2
1
IMPACT FORCE
TRANSMITTED
TO BALL
ROPE FREE
TO MOVE
ROPE FREE
TO MOVE
10
10
10
ROPE PINCHED
ROPE FREE
TO MOVE
20
20
ROPE FREE
TO MOVE
20

Fig. 7A
Fig. 7B
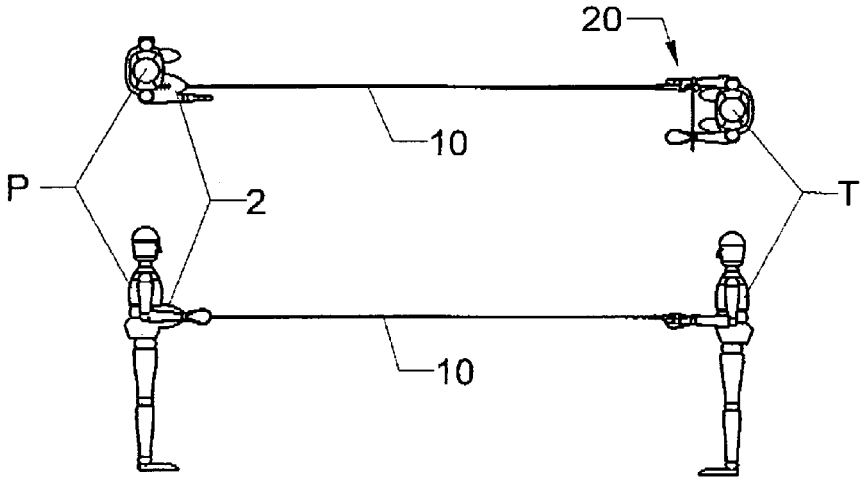
Fig. 8A
Fig. 8B
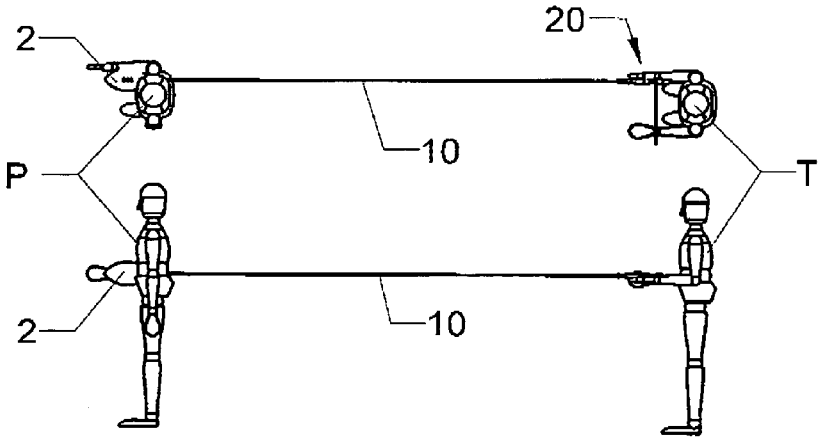

TRAINING TOOL AND METHOD FOR BALL HANDLING

FIELD OF INVENTION

This invention relates to ball handling training, in particular to tools, devices, apparatus, systems and methods to enhance ball handling skills and reduce and eliminate fumbling of balls, from football players, basketball players, rugby players and the like.

BACKGROUND AND PRIOR ART

Fumbling a game ball, such as a football has been a problem since the invention of the game. When a player who has possession of the ball fumbles, it can change to the course of a game, a season, and even a career. No better example exists than Ernest Byner's fumble in the 1987 AFC Championship Game. When Ernest Byner fumbled the ball at the opposing team's 2 yard line with 1:12 to play, it changed not only the game, but many people believe the entire Cleveland Brown's franchise. This well known fumble was such a historic event that it has its own Wikipedia page titled simply, "The Fumble." Even though Ernest Byner went on to several Pro Bowls and won a Superbowl ring with the Washington Redskins, he is still most remembered for The Fumble. This shows the importance of ball security better than any other story.

It has become customary for trainers and coaches to follow players as they perform drills and punch, slap, or hit the ball with their hand to simulate game like conditions. There are several problems with this technique. One, it is very difficult if not impossible to simulate the element of surprise. The player will almost always see the trainer or coach (the word trainer will be used from this point forward to mean the person holding the Slap Handle) and know the impact is coming. Two, it is very strenuous on the trainer. He must move with the player and attempt to hit the ball with the same force a trained athlete will be applying during the game. Lastly, it is not very effective. The trainer cannot hit the ball with precision very often, and the force is not nearly as high as it would be if the trainer were an actual opposing player running full speed to tackle the ball carrier and contacting the ball with their helmet. The invention overcomes all of these shortcomings, and provides the best tool in existence for training players to secure the football.

The Fisher Tug-A-Ball product attempts to address some of the issues by allowing the trainer to tug on the ball during drills, but it is simply a nylon strap having one end that covers the ball and the trainer pulls on the other end of the elongated strap. This simple strap does not address the issue of insufficient force as the pulling motion will create only a low force without the simulation of a sharp impact that would result from an opposing player hitting the ball with their helmet or punching at the ball to cause a fumble. Additionally, it does not address the issue of stress and strain on the trainer as it will place a lot of stress on the arm and shoulder of the trainer if they try to recreate game-like forces. Additionally, the raised straps wrapped around the football changes the gripping surface so that it no longer feels like a football, and thus, is not a realistic simulation of holding onto a real football.

Various types of patents have been disclosed over the years that attach tether type lines to footballs. See for example, U.S. Pat. Nos. 3,042,404 to Masters; 3,227,450 to Pruitt; 3,804,409 to Schachner; 3,940,133 to Civita. However, these devices are generally limited cords and elastic type bands that are primarily used for retrieving footballs. These devices have little capability of being useful for fumble training over the previously described Fisher Tug-A-Ball product.

Other types of modified footballs have been developed specifically for fumble training that use weighted footballs. See for example, U.S. Pat. Nos. 3,450,407 to Russo and 5,261,661 to Lemmon. However, a weighted ball does not allow for a trainer to surprise the player being trained, and again does not simulate the game like forces of an opposing player attempting to punch, hit or immediately pull the football away from a player.

Other types of ball handling games such as basketball, rugby, and the like have similar fumbling problems to those referenced above. Thus, the need exists for solutions to the above problems with the prior art.

SUMMARY OF THE INVENTION

A primary objective of the present invention is to provide tools, devices, apparatus, systems and methods to enhance ball handling skills and reduce and eliminate fumbling of balls, from football players, rugby players, and the like.

A secondary objective of the invention is to provide tools, devices, apparatus, systems and methods to train players to hold a ball in the most secure manner possible at all times in a game to reduce or even eliminate fumbling.

A third objective of the present invention is to provide to tools, devices, apparatus, systems and methods to enhance ball handling skills and reduce and eliminate fumbling of balls, from football or basketball or rugby players that replicate real game conditions of an opposing player attempting to slap, hit, grab or pull a ball from another player.

A fourth objective of the present invention is to provide to tools, devices, apparatus, systems and methods to enhance ball handling skills and reduce and eliminate fumbling of balls, from football or basketball or rugby players, using a surprise force that attempts to force a fumble of the ball from the player.

A fifth objective of the present invention is to provide to tools, devices, apparatus, systems and methods to enhance ball handling skill, reduce and eliminate fumbling of balls, from football or basketball or rugby players, that will not place excessive stress on the arm and shoulder of the trainer if they try to recreate game-like forces to dislodge the ball from the player.

A training tool for enhancing ball handling skills, can include a slidable handle having an outer grip surface with a weighted end, and a hollow interior, a post having an upper end and a lower end with an enlarged base, wherein the handle freely slides up and down on the post between the upper end and the enlarged base, and a cord having a first end attached to the tool and a second end adapted to be attached to a ball, wherein gripping the outer surface of the handle allows a trainer to flick the handle along the post so that the weight impacts another surface causing a shockwave that travels down the cord to the attached ball.

The first end of the cord can be attached to the a ring on the post.

The enlarged base of the post can include an impact surface for receiving the weighted end of the sliding handle.

The ball can be a football. The ball can be a basketball, or rugby ball.

The post can be hollow, and the cord passes through the upper end of the post and exits out of the post adjacent to the enlarged base.

The enlarged base of the post can include an impact surface for receiving the weighted end of the sliding handle. At least one spring can be used for attaching a top end of the handle to the upper end of the post, and the weighted handle is on a bottom of the handle. Two springs or more, can be used, each on opposite sides of the post for attaching the top end of the handle to the upper end of the post.

The weighted end of the sliding handle can include a lower surface with a recess portion for crimping a portion of the cord when the weighted end of the sliding handle strikes the impact surface of the enlarged base of the post.

The impact surface of the enlarged base can include an impact surface with a recess portion for crimping a portion of the cord when the weighted end of the sliding handle strikes the impact surface of the enlarged base of the post.

A training method for enhancing ball handling skills of a player can include the steps of providing a post having an enlarged end, attaching one end of a cord to the post, attaching an opposite end of the cord to a ball, stretching the cord to a taught condition by having one person hold the ball and another person holding the post, sliding a weight on the post to impact the enlarged end, and generating a shockwave to the ball through the stretched cord. The ball can be a football. The ball can be a basketball. The ball can be a rugby ball. The method can include the step of reciprocating the sliding weight back to an initial position by at least one spring, and repeating the impacts to continuously generate shockwaves to the player carrying the ball.

Further objects and advantages of this invention will be apparent from the following detailed description of the presently preferred embodiments which are illustrated schematically in the accompanying drawings.

BRIEF DESCRIPTION OF THE FIGURES

Dynamic Version

FIG. 3C is an enlarged cross-sectional view of the entire dynamic slap handle of FIG. 3A.

FIG. 7A is a top view of trainer in front of a ball carrier using the novel invention.

FIG. 7B is a side view of the trainer in front of the ball carrier of FIG. 7A.

FIG. 8A is a top view of a trainer behind a ball carrier using the novel invention.

FIG. 8B is a side view of the trainer behind the ball carrier of FIG. 8A.

Static Version

Figure 9:
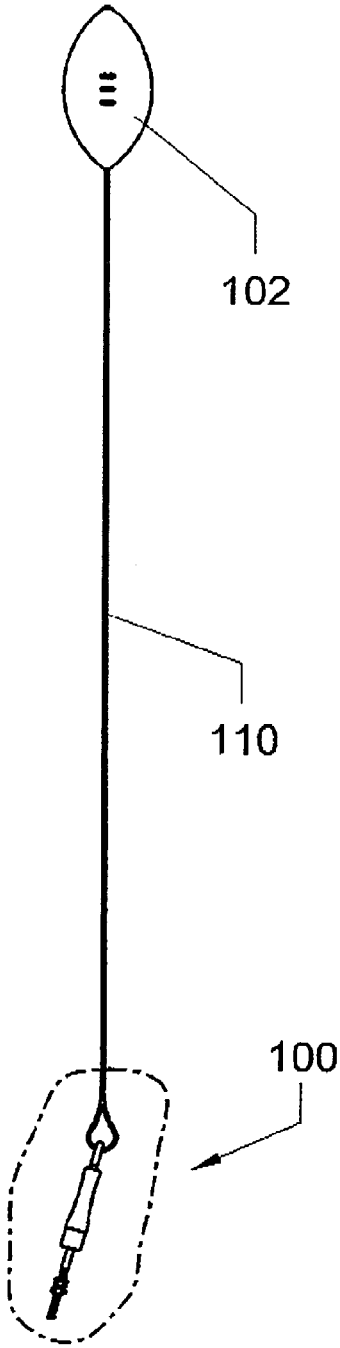

FIG. 9 shows a static slap handle invention at rest attached by a cord to a football.

Figure 9C:
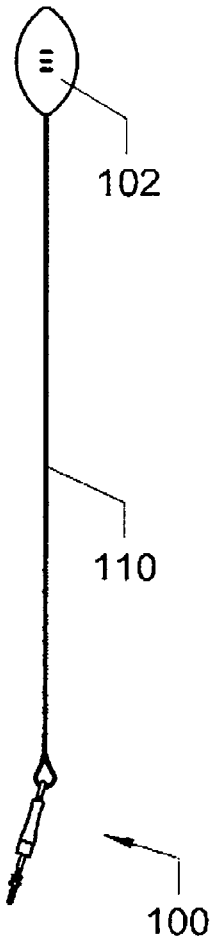
Figure 9B:
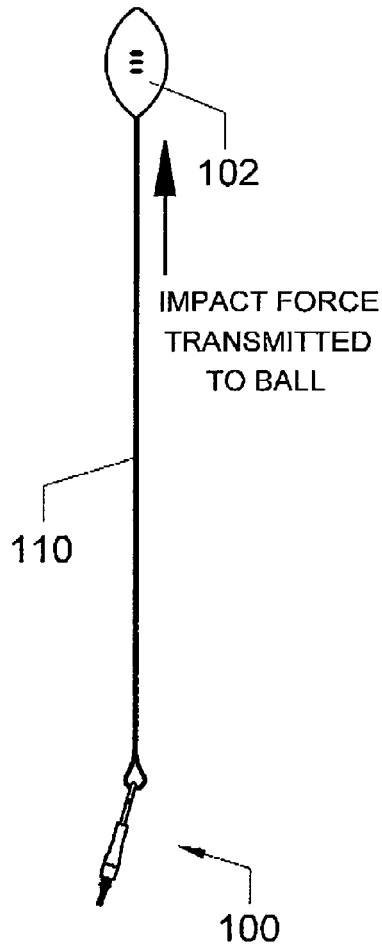
Figure 9A:
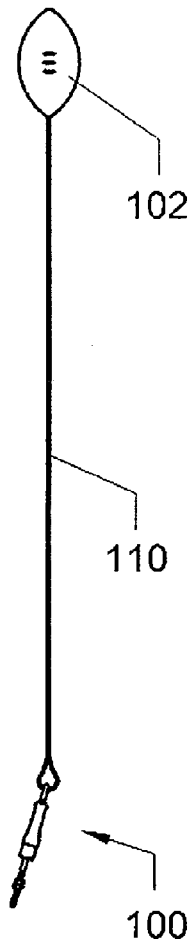

FIG. 9A is another view of the slap handle at rest with attached football of FIG. 9.

FIG. 9B shows the slap handle of FIG. 9A at impact position with attached football.

FIG. 9C shows the slap handle of FIG. 9B moved back to rest position.

Figure 10:
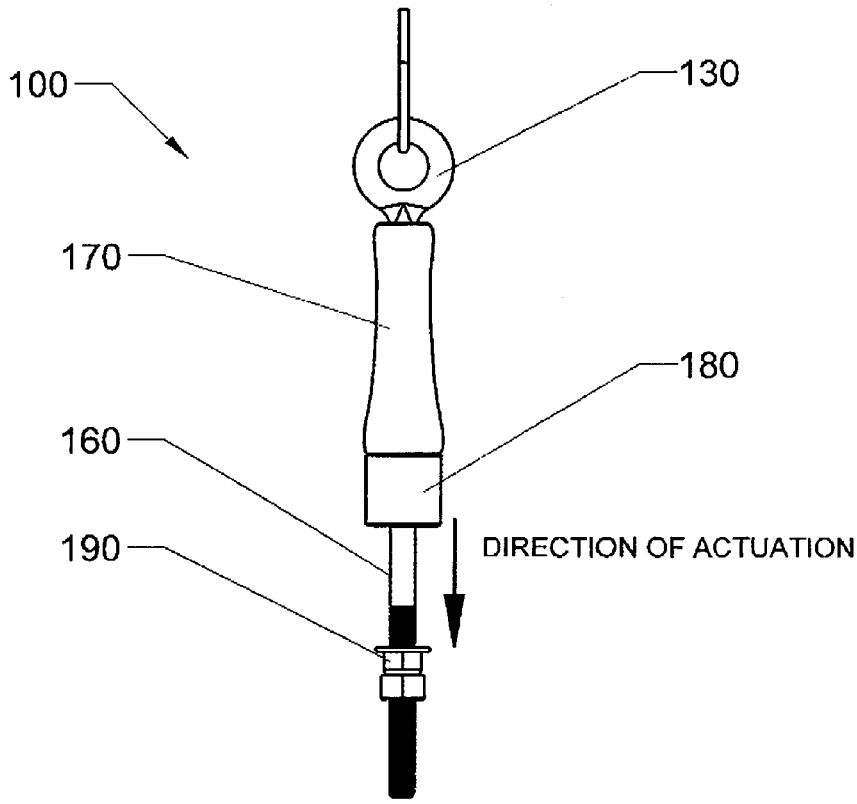

FIG. 10 is an enlarged view of the static slap handle of FIGS. 9 and 9A at rest.

Figure 11:
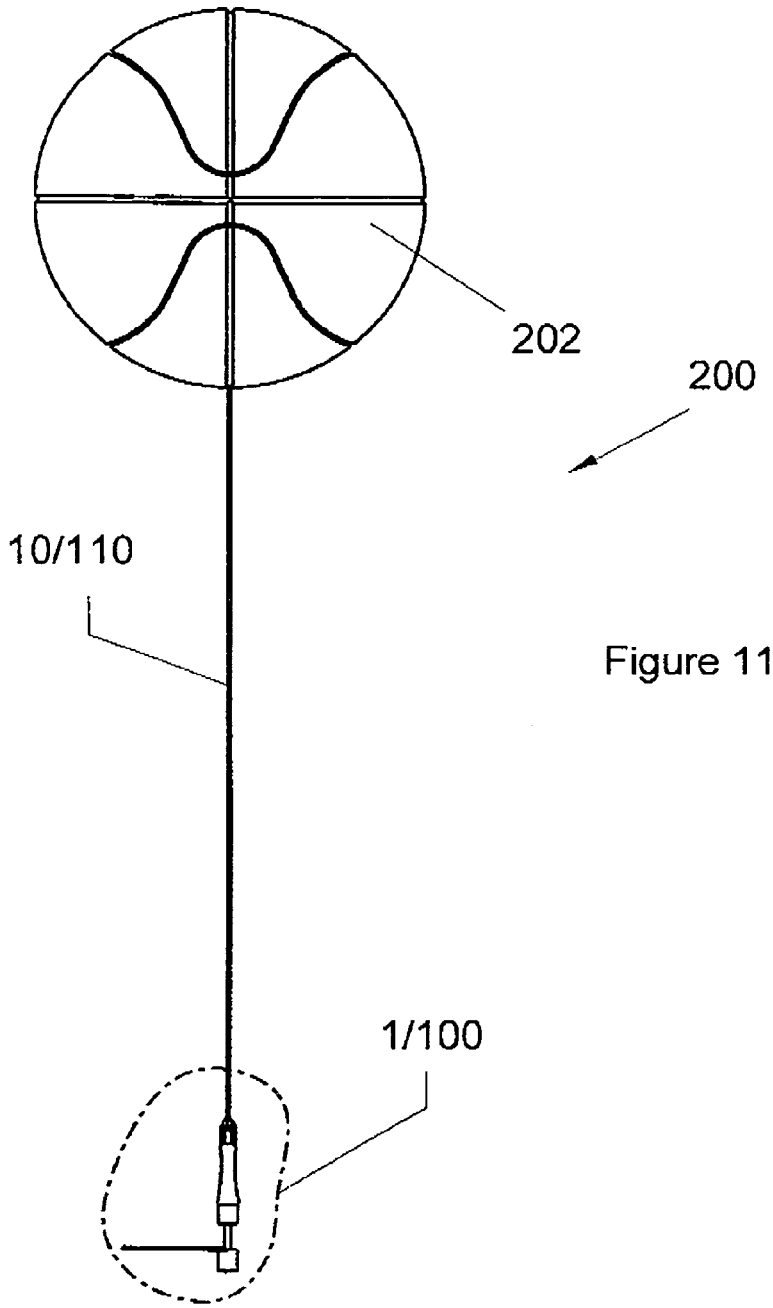

FIG. 11 shows the dynamic slap handle attached to a basketball.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

Figure 1:
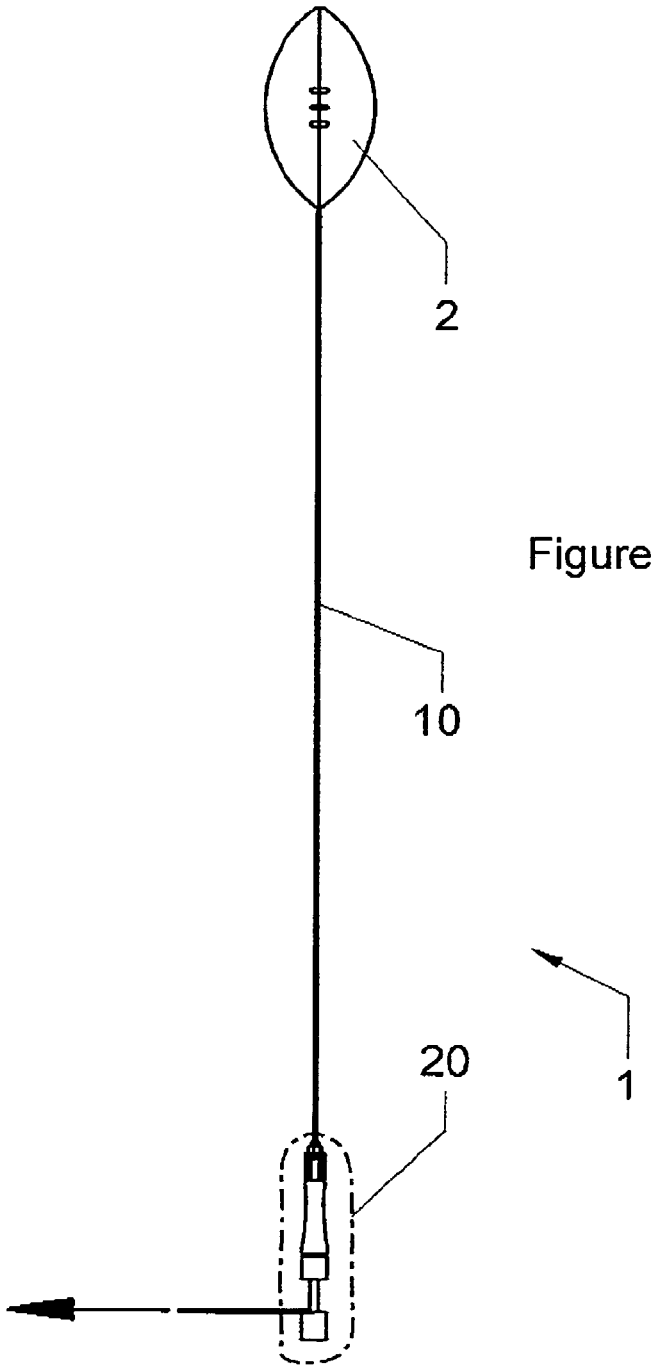
FIG. 1 shows a dynamic slap handle invention at rest attached by a cord to a football.
Figures 1A, 1B, 1C:
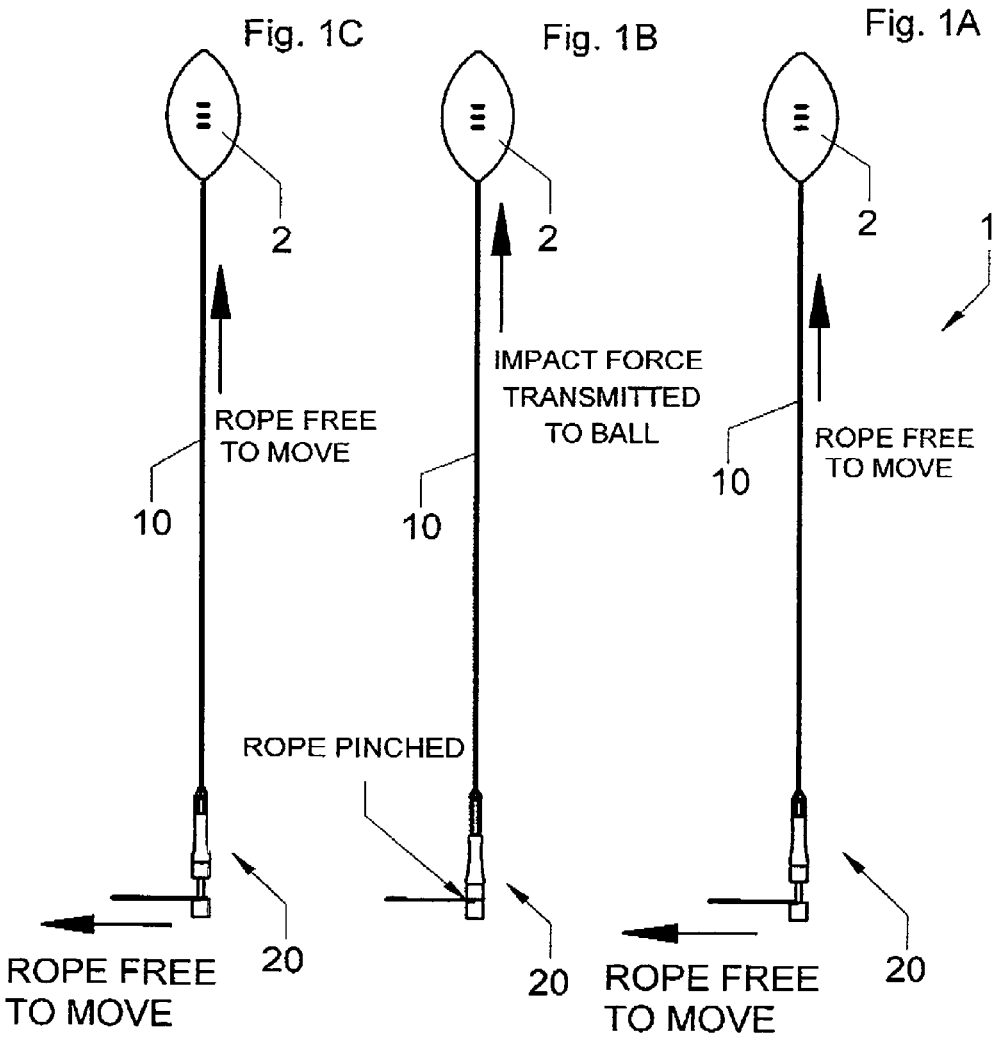
FIG. 1A is another view of the slap handle at rest with attached football of FIG. 1.
FIG. 1B shows the slap handle of FIG. 1A at impact position with attached football.
FIG. 1C shows the slap handle of FIG. 1B moved back by the springs to rest position.

1. dynamic slap handle embodiment with football
2. football
4. laces
10. cord
12. knot or swage inside ball
18. free end of cord coming out of slap handle
20. dynamic slap handle
30. top flanged nut on top of tube
32. outwardly extending edges
33. through-holes in edges
40. left spring
42. upper hook end
48. lower hook end
50. right spring
52. upper hook end
58. lower hook end
60. hollow handle tube
67. lower side opening
70. sliding handle grip
80. weight on bottom of sliding handle grip
87. angled edges (chamfers)
90. enlarged base on tube with impact upper surface
92. impact surface
95. recessed area or groove or step in impact surface
97. angled edges (chamfers)
98. lower self locking nut fastener
99. lower side opening for tying off cord to convert dynamic to static
100. static slap handle embodiment with football
102. football
110. cord
130. eye hole ring for top of post
160. post/tube
170. sliding handle grip
180. weight on bottom of sliding handle grip
190. enlarged base on post/tube with impact upper surface
200. basketball version
202. basketball Dynamic Version FIG. 1 shows an embodiment 1 dynamic slap handle invention 20 at rest attached by a cord 10 to a football 2. FIG. 1A is another view of the slap handle 20 at rest with attached football 2 of FIG. 1. FIG. 1B shows the dynamic slap handle 20 of FIG. 1A at impact position with attached football 2.

FIG. 1C shows the dynamic slap handle 20 of FIG. 1B moved back by the springs 40, 50 to rest position. The different positions of the dynamic slap handle 20 will be described in relation to FIGS. 2-5, and the football 2 and cord 10 attachment will be described in reference to FIG. 6

Figure 2:
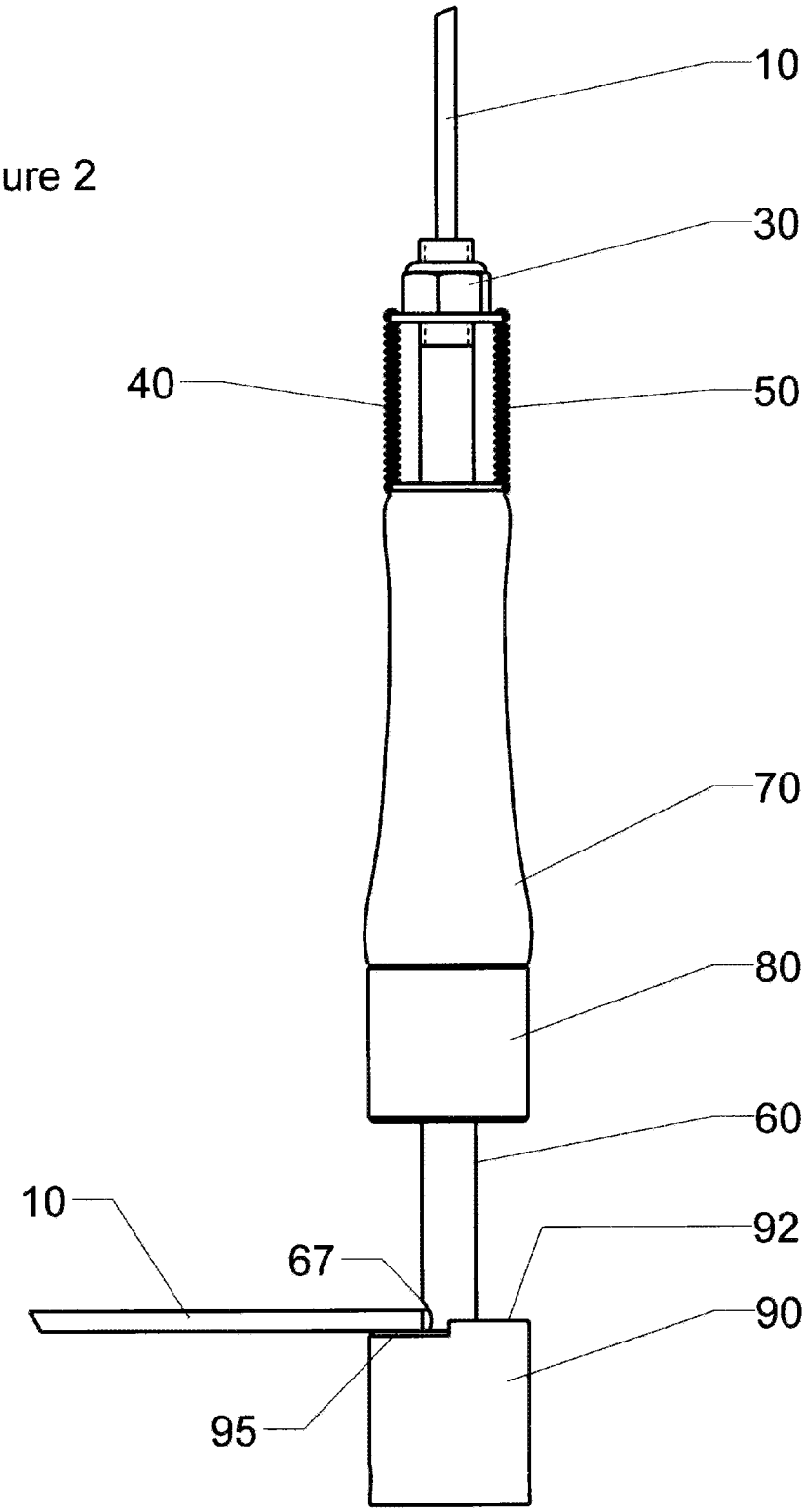
FIG. 2 is an enlarged view of the dynamic slap handle of FIGS. 1 and 1A at rest.
Figure 3A:
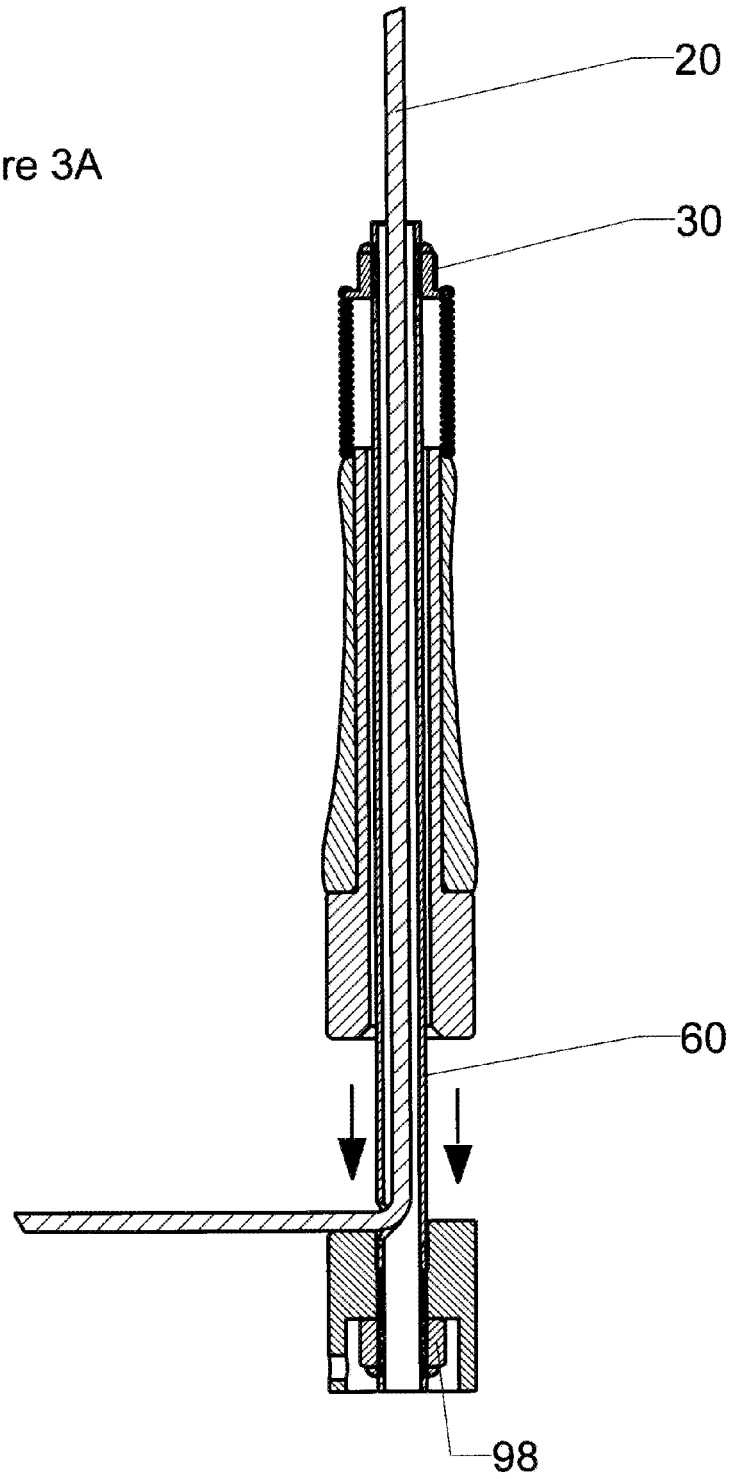
FIG. 3A is a cross-sectional view of the dynamic slap handle of FIG. 2.
Figure 3B:
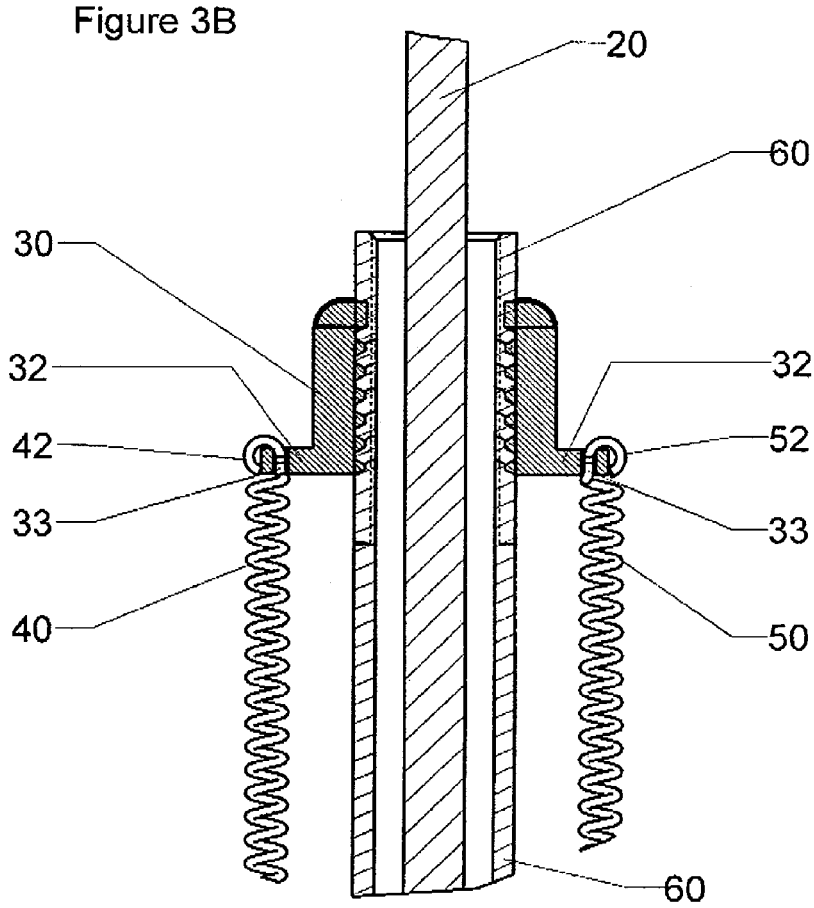
FIG. 3B is an enlarged upper cross-sectional view of the dynamic slap handle of FIG. 3A.

FIG. 2 is an enlarged view of the dynamic slap handle 20 of FIGS. 1 and 1A at rest. FIG. 3A is a cross-sectional view of the dynamic slap handle 20 of FIG. 2. FIG. 3B is an enlarged upper cross-sectional view of the dynamic slap handle 20 of FIG. 3A. FIG. 3C is an enlarged cross-sectional view of the entire dynamic slap handle 20 of FIG. 3A.

Referring to FIGS. 1, 1A, 1B, 1C, 2, 3A, 3B, and 3C, the dynamic slap handle 20 can include an enlarged top 30 such as a self locking flanged nut having internal threads that mateably thread about outer threads on top of a hollow tube 60. The enlarged top 30 (such as the flanged lock nut) can provide a shoulder to mount the return springs 40, 50 and prevent the sliding handle grip 70 with sliding weight 80 from separating from the slap handle 20. The enlarged top 30 can have outwardly extending edges 32 having through holes 33 where the upper hook ends 42, 52 of left spring 40 and right spring 50 respectively hook onto. Each of the spring hook ends 42, 52 loops through the through-holes 33 in flange edges 32 of the enlarged top 30. The lower hook ends 48, 58 of each of the springs 40, 50 similarly hook onto through-holes on the upper end of the sliding handle grip 70. The springs 40, 50 are used as return springs to keep the sliding handle grip 70 in a rest or "armed" position for quick repeating impacts of the weight 80 on the bottom of the sliding handle grip 70.

The return springs 40, 50 can be replaceable should they become worn, break, or stretch to a point that they are no longer effective. Another benefit of this feature is that by varying the unsprung length of the spring the travel distance of the sliding weight 80 can be varied. This is important because the distance the sliding weight 80 has to travel to make contact will directly affect the amount of force generated. For younger players, the trainer may want to use less force than they would at the professional level. The trainer could simply change out the return springs 40, 50 to reduce the sliding weight 80 travel and therefore reduce the amount of force the ball carrier will experience.

The sliding handle grip 70 can have an outer contoured (concave curved surface) to allow for enhanced gripping action by the single hand of a trainer. Wrapped about the sliding handle 70 can be an ergonomic rubber grip that is designed for comfort and safety. The rubber grip can reduce the shock transmitted to the user holding the slap handle 20 and will prevent the user's hand from slipping off the sliding handle 70 with sliding weight 80. The inside the sliding handle grip 70 is hollow so as to allow for the handle grip 70 to freely and loosely slide about the hollow tube 60. The bottom of the sliding handle grip 70 can have a weight 80, such as a metal weight fixably attached thereon. The slide weight 80 can be a metal mass that is free to slide up and down the handle tube 70 with little or no resistance (when the return springs 40, 50 are not attached).

The novel slap handle 20 can utilize sliding weights 80 of different masses to control the amount of force that is transmitted to the football 2. A more massive sliding weight 80 will generate a higher impact force than less massive sliding weight 80. The design of the football 2 even allows for interchangeability of this feature.

Fixably attached to the bottom of the hollow tube 70 can be an enlarged hollow base 90, having a fastener, such as a self locking nut 98 with internal threads that mateably thread about outer threaded surface on a bottom of the hollow tube 70. The handle stop 90 (enlarged base) can be a metal disk that is threaded onto the bottom of the handle tube 60. The top of the enlarged base 90 can have an impact surface 92 with a groove or lower step portion 95 that allows the cord 10 to pass therethrough. The enlarged base 90 functions as a stop for the sliding handle grip 70 so that a shockwave (pressure pulse) from the weight 80 impacting with the impact surface 95 of the base 90 is able to be transferred to the cord 10, which will now be described. The cord 10 passes through the top of the hollow tube 60 and out a lower side-opening 67 in the tube 60.

The cord 10 can be a nylon rope that has a smooth, soft finish to protect the end user. The cord 10 can be a high tensile strength rope that can handle the large forces created by the Slap Handle without stretching or failing. The end of the cord that is not terminated inside the football 2 can be knotted to prevent the cord from accidently coming all the way out of the Slap Handle 20. This knot can be easily undone to allow the conversion of the Dynamic version to a Static of FIGS. 9-10. The cord 10 can also be selected to handle the bad weather environment in which football or basketball is often practiced and played.

Referring to FIGS. 1, 1A, 1B, 1C, 2, 3A, 3B, and 3C, the handle tube 60 can be a metal tube 60 (such as but not limited to steel, aluminum and the like) that allows the cord 10 attached to the football 2 to slide freely down the inside of the tube 60 and exit out of the tube 60 through a lower side hole 67 located adjacent to where the tube 60 and the handle stop 90 (enlarged base) intersect. This allows the distance between the football and the slap handle 20 to vary while keeping the slide handle grip 70 with slide weight 80 in its rest and armed position.

Figure 4A:
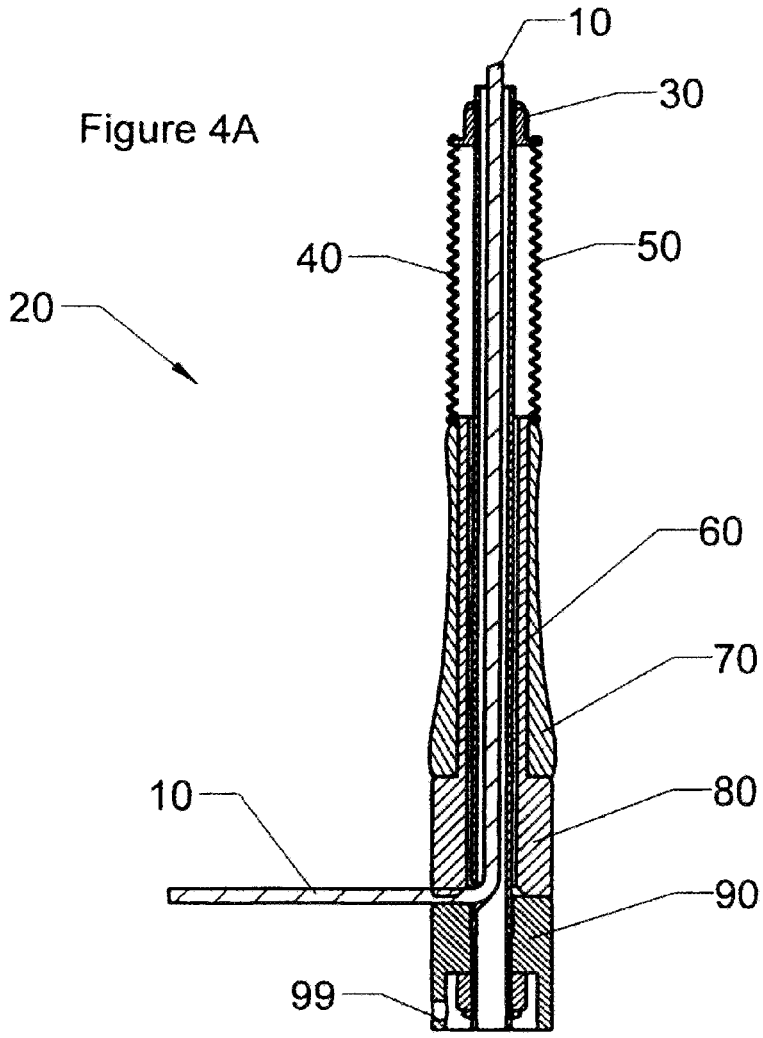
FIG. 4A is a cross-sectional view of the dynamic slap handle of FIG. 1B slid to impact position.
Figure 4B:
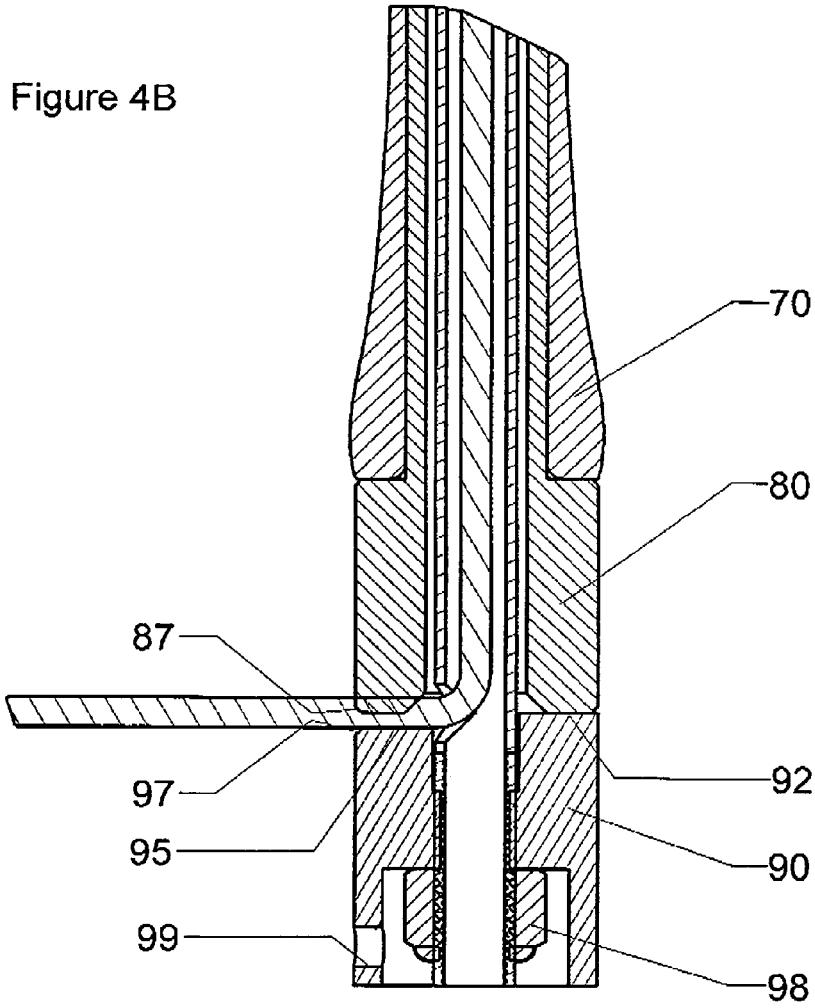
FIG. 4B is an enlarged lower cross-sectional view of the dynamic slap handle of FIG. 4A.

FIG. 4A is a cross-sectional view of the dynamic slap handle 20 of FIG. 1B slid to impact position. FIG. 4B is an enlarged lower cross-sectional view of the dynamic slap handle 20 of FIG. 4A.

Referring to FIGS. 1-4B, when the slide weight 80 on the bottom of the gripping handle 70 is slid down the tube 60 in a slapping, jarring manner, the bottom of the sliding weight 80 will pinch the cord 10 so that the cord 10 becomes taut and capable of transmitting load to the football 2. At the exact moment the cord 10 is pinched, the sliding weight 80 also contacts the handle stop 90 (enlarged base) and creates a large impact force. This impact force (shockwave) is transmitted through the now taut cord to the football 2.

The handle stop 90 (enlarged base) can be impacted by the sliding weight 80 on the bottom of the sliding handle 70 to create the large impact force which is transmitted to the ball. It also provides the surface for the sliding weight 80 to pinch the cord 10. The side hole 67 in the handle tube 60 can be located adjacent to the top of the recessed or grooved or stepped surface 95 in the handle stop 90 where the cord 10 exits the tube 60 at side opening 67. This is the pinch point for the cord 10. Chamfers (angled edges) 87 on the sliding weight 80 and chamfers (angled edges) 97 on the handle stop 90 can prevent damage to the cord 10 from the pinching action. There can also be a hole 99 adjacent the bottom of the handle stop 90 for tying off the cord 10 to convert the Dynamic version to a Static version as described below.

As previously described, the return springs 40, 50 can be tension springs attached to the enlarged top 30 (flanged lock nut) and to the top of the sliding handle 70 that hold the slide weight 80 in the rest and armed position until the user is ready to actuate the slap handle 10 and create the impact force shock that is transmitted to the football 2. Once the sliding weight 80 is slapped down onto the handle stop 90 (enlarged base) the return springs 40, 50 are in tension, and immediately after the impact the springs 40, 50 pull the sliding handle grip 70 with sliding weight 80 back to its rest and armed position. This allows the impact force to be repetitively applied during drills. The springs 40, 50 can be sized so that they are able to hold the sliding handle grip 70 with sliding weight 80 in the rest and armed position even when the cord 1 is being feed out of the side of the handle tube 60 (thus overcoming any friction created), yet the springs 40, 50 do not impede the actuation of the slap handle 20 (not so strong that the user can't make the sliding weight 80 slaps into the handle stop 90 (enlarged base).

The nut 98, such as standard lock nut can be used as a jam nut to prevent the shock of the impact forces from backing off the handle stop 90 (enlarged base) from the handle tube 60. It also allows the handle stop 90 (enlarged base) to be properly located with the recessed area 95 aligned with the cord exit hole 67 in the handle tube 60, and then locked into that position.

Figure 5:
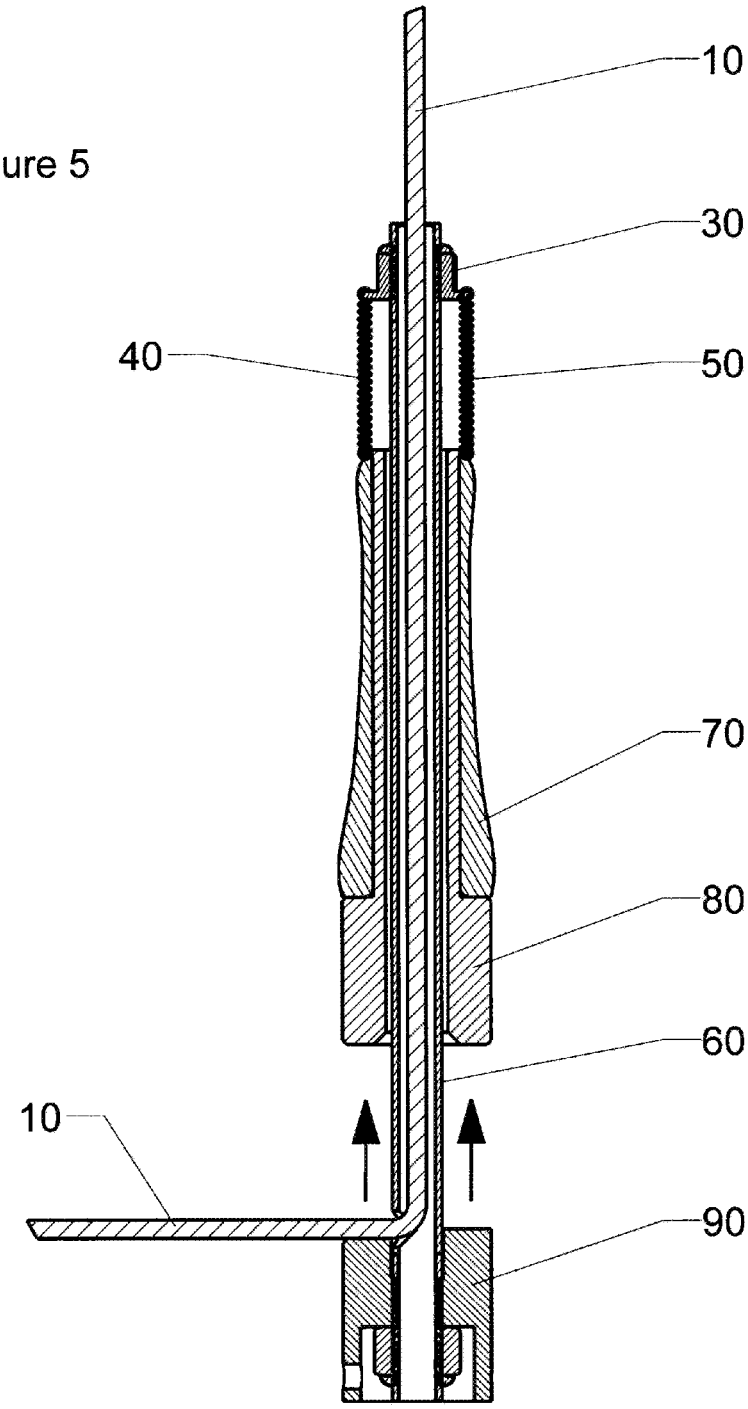
FIG. 5 is another cross-sectional view of the dynamic slap handle of FIG. 1C having been retracted back by the springs to the rest position.

FIG. 5 is another cross-sectional view of the dynamic slap handle 20 of FIG. 1C having been retracted back by the springs 40, 50 to the rest position.

Figure 6:
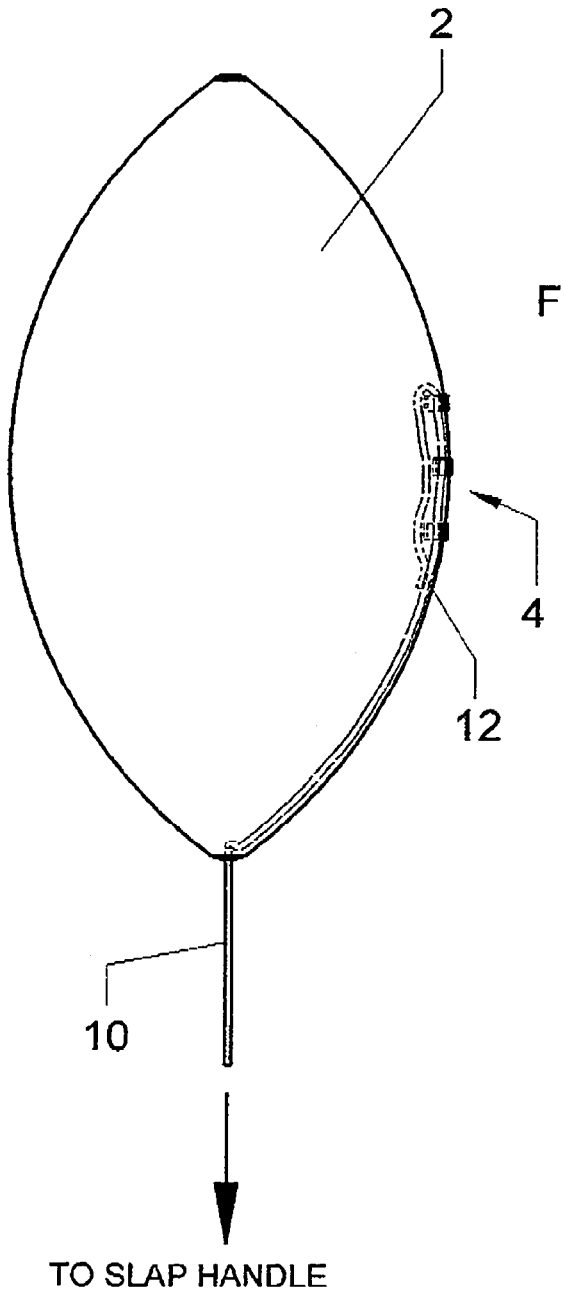
FIG. 6 is a cross-sectional view of the football and cord connection of FIG. 1.

FIG. 6 is a cross-sectional view of the football 2 and attachment for the cord 10 of FIG. 1. The football 2 can be a standard regulation football (all official sizes can be used) that has a cord end permanently attached to the inside of the ball, which then exits the ball at one of the two points (where the four panels of the football meet, aka the "tip"). With the exception of the cord, the ball can have the exact same feel, size, shape, and weight (within two ounces) of a regulation ball used in officially sanctioned games. This allows the end user to train with a ball that feels exactly the same in practice as in the game. The cord 10 attached by entering the football 2 at the point, looping through the laces 4 (the part of the laces inside the football), and then wrapping back to itself and terminating via knot 12 or swage to itself. All of this takes place inside the football without damaging the internal bladder of the ball. This leaves the cord 10 exiting the ball as the only visible difference from a regulation game ball 2.

The football 2 can be fabricated with any size football for use at any level or age group. The concept of operation is the exact same, but having various sizes of footballs allows for players to use the exact football 2 they will use in competition. This also allows players that are ready to move to the next level to practice with a ball 2 they will be using in the future to better prepare themselves.

FIG. 7A is a top view of trainer T in front of a ball carrier P using the novel invention. FIG. 7B is a side view of the trainer T in front of the ball carrier P of FIG. 7A. FIG. 8A is a top view of a trainer T behind a ball carrier P using the novel invention. FIG. 8B is a side view of the trainer T behind the ball carrier P of FIG. 8A.

Holding the Slap Hammer

Referring to FIGS. 1-8B, the trainer T grabs the contoured surface of the sliding handle 70 with their dominant hand and hold the slap handle 20 at an approximate angle of 45 degrees with respect to horizontal (i.e. 45 degrees from parallel to the ground) with the handle stop 90 (enlarged base) at the bottom (i.e. closer to the ground). The trainer T should hold the sliding handle grip 70 firmly so that the slap handle 20 will not be jarred from the trainers hand even under high impact loads. The opposite end of the cord 10 with the football 2 attached should be going away from the trainer's front, so that the trainee (the ball carrier) P will be holding the ball 2 and standing in front of the trainer 2. The springs 40, 50 will keep the slap handle 20 in the "armed" position (the "armed" position is when the cord 10 is free to go in and out of the handle tube 60, and that the sliding weight 80 is several inches from the handle stop 90 and ready to be slid down the handle tube 60 to contact the handle stop impact surface 92). The trainer T should hold the excess end 18 of the cord 10 that exits opening 67 with their other hand. This hand will actively retract the cord to maintain tautness in the cord, or passively allow the cord to feed out during drills.

Location of the Ball Carrier

The ball carrier P should stand in front of the trainer T either facing the trainer T or facing away from the trainer T, with the difference being the direction of the force that will be imparted to the ball 2. It is solely up to the preference of the trainer T and how they would like to execute the drill, but it is recommended that equal time be spent with the ball carrier P in each position. It should be noted here that each position simulates different real life forces that the ball carrier P will experience in game situations.

Once the trainer T decides where they prefer to stand for the impending drill, the player P should take hold of the football 2 and the pair T 7 P should move to a distance of approximately 15 feet apart. It should be noted that the distance of 15 feet can be varied to meet the preferences of the trainer and the ball carrier P, or for specific drills.

The trainer T should remove most or all of the slack in the cord between the ball carrier C and the trainer T by pulling the cord 10 through the side opening 67 in the handle tube 60 with the hand holding the excess cord 10 as described above.

Holding the Football

The football 2 should be held by the player P being trained as he would normally hold a football 2; with four points of contact (the fingertips, the forearm, the bicep, and the chest), and high and tight to the body. If the ball carrier P is to be facing away from the trainer T, then the ball 2 should be held with the cord 10 exiting the ball 2 and going behind the player P. Likewise, if the ball carrier P is to be facing toward the trainer 10, the ball should be held with the rope exiting the ball 2 and going in front of the player. Care should be taken that the cord 10 is not tangled or wrapped around anything or any body part.

Actuating the Slap Handle

Once the ball carrier P and the trainer T are in the proper positions, holding the slap handle 20 properly, and holding the football 20 in the proper position, the trainer T is ready to actuate the slap handle 20. The ball carrier P can either be standing still or in motion, depending on the drill. Once ready to actuate the slap handle 20, the trainer T should keep the cord 10 taut by either pulling the excess rope 18 through the opening 67 in the handle tube 60, or allowing the cord to be feed out as necessary. When the trainer T is ready to impart the impact force on the ball 2, the trainer T shall slide the sliding handle grip 70 with sliding weight 80 down toward the handle stop 90 quickly, causing the sliding weight 90 to slap into the impact surface 92 of the handle stop 90. The speed of actuation will change the force imparted onto the ball 2, and it will be up to the preference of the trainer T how quickly to slide the sliding weight 80 down to the handle stop 90. The springs 40, 50 will cause the sliding handle grip 70 and sliding weight 80 to reset automatically so that the slap handle 20 is ready for the next actuation. The amount of actuations and the duration of the drill are up to the preference of the trainer T. Should the ball carrier P move away from the trainer T during the drill, the cord 10 is simply allowed to feed out between actuations of the slap handle 20. If the ball carrier P moves toward the trainer T, the trainer T shall use their free hand (the one holding the excess cord 18) to pull the cord 10 through the handle tube 60 to remove slack so that the cord remains taut between actuations of the slap handle 20.

The trainer or coach T can repeat the impact force generation as often as they wish in order to teach the player not to easily fumble the carried football.

Although the enlarged base 90 (handle stop) and bottom of tube 60 are shown as separate components, the invention can have a one piece formed enlarged stop on the bottom of the tube. Also, although the enlarged top and top of the tube are shown as separate components, these parts can also be formed from one piece.

While the enlarged base is shown as the impact stop, the invention can be practiced by having the enlarged top become the impact stop. Alternatively, both the enlarged top and the enlarged bottom can be used as impact stops as well.

Although the recessed portion or step is shown in the impact surface of the enlarged base, the recessed portion can be on the bottom of the sliding weight.

The invention can be made from materials design to survive the elements. However, it is recommended that the equipment be stored in a clean, dry condition. Additionally, care should be taken to clean all mud and debris from the slap handle 20 to ensure smooth operation and optimal performance.

Overall, the football 2 can be customized using a variety of football sizes and various sliding weight masses to achieve the perfect combination for any age group Conversion to Static Version (from the Dynamic Version)

There can be drills or instances where the trainer would prefer the length of cord between the slap handle 20 and the football 2 to be fixed. In these cases, the cord 10 can simply be feed down the tube 60 to exit out of the bottom instead of the exit hole 67 where the tube 60 and handle stop 90 meet. Then the cord 10 is routed up the inside cavity of the handle stop 90, out through the tie-off hole 98 in the handle stop 90, and looped around and tied off to itself. Using a secure knot, the cord will now maintain a fixed length between the slap handle 20 and the football 2.

Static Version

FIG. 9 shows a static slap handle invention 100 at rest attached by a cord 110 to a football 102. FIG. 9A is another view of the static slap handle 100 at rest with attached football 2 of FIG. 9. FIG. 9B shows the static slap handle 100 of FIG. 9A at impact position with attached football 102. FIG. 9C shows the static slap handle 100 of FIG. 9B moved back to rest position. FIG. 10 is an enlarged view of the static slap handle 100 of FIGS. 9 and 9A at rest.

Referring to FIGS. 9-10, the static version 100 eliminates the need for return springs 40, 50, by having the end of the cord 10 tied off on an eyehole ring 130 that is fixably attached to an upper end of a post/tube 160. Here, the slidable hand grip 170 with ergonomic contoured surface has a sliding weight 180 at the bottom, which freely slides up and down on the post/tube 160. An enlarged base 190 such as a flanged nut is threaded onto exterior threads on the bottom of post/tube 160 to create a handle stop. The operator (trainer or coach) can pump and/or jerk their hand up and down holding the static version 100 causing the sliding weight to continuously impact the top of the flanged nut. The user operates the static version similar to the dynamic version and imparts a shockwave (pulse) down the taught cord 110 to the football 102 each time the sliding weight hits the base, order to teach the player not to fumble the carried football 102.

FIG. 11 shows another version 200 of the dynamic slap handle 1 or static handle 100 can be attached to a basketball 202. Similarly, both the static or dynamic versions described above, can also be used to teach basketball players from fumbling the ball.

Still furthermore, the invention can be used with reducing and eliminating ball fumbling from other sports, such as but not limited to rugby, and the like.

Motorized Slap Handle

A motorized version of the invention can be similar in operation to the dynamic version and can allow for the cord 10 to move freely until the point of actuation just like the dynamic version, and it uses the moving mass (the sliding weight) to both create the impact force and to pinch the cord to lock it into position (relative to the ball). However, in the motorized version, the mass is put into motion by a mechanism that is push button actuated, as opposed to the user manually moving the mass to impact the Handle Stop component of the slap handle 20.

The mechanism used to move the mass can either be a pneumatic piston that is charged with air or fluid, or a solenoid that uses an electric current.

For the pneumatic or fluid version, an air compressor or pump recharges the piston between each actuation. When the actuation button is pressed on the slap handle, the piston is mechanically released and the air pressure built up in the piston shoots the piston, and thus the mass, down toward the handle stop to create the impact force and pinch the cord.

In the solenoid version, when the actuation button is pressed the coil of the solenoid can create a magnetic force to accelerate the moving mass (made from a ferrous material such as iron) down toward the handle stop. The mass impacts the handle stop creating the impact force and pinching the rope. This version can be run off a battery or off 120 volts AC (standard household electricity).

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A training tool for enhancing ball handling skills, comprising:

a single handle for the tool, the single handle having an outer grip surface with a weighted lower end, the single handle adapted for allowing the tool to be gripped and operated only by a single hand of a user;

a post having an upper end and a lower end with an enlarged base contiguous around the lower end of the post which forms a stop with an impact surface, wherein the single handle freely slides up and down on the post between an upper position and a lower position, and at the lower position the weighted lower end directly and only contacts against the impact surface of the stop; and a cord having a first end attached to the upper end of the post, and a second end adapted to be attached to a ball, wherein gripping the outer surface of only the single handle allows a trainer to flick the handle along the post so that the weight directly and only impacts against the impact surface sending shockwave that travels down the cord to the attached ball.

2. The training tool of claim 1 wherein the upper end of the post includes:

a ring, and the first end of the cord is attached to the ring.

3. The training tool of claim 1, wherein the ball is a football.

4. The training tool of claim 1, wherein the ball is a basketball.

5. The training tool of claim 1, wherein the ball is a rugby ball.

6. A training tool for enhancing hall handling skills, comprising:

a slidable handle having an outer grip surface with a weighted end, and a hollow interior;

a hollow post having an upper end and a lower end with an enlarged base with an impact surface for receiving the weighted end of the sliding handle, wherein the handle freely slides up and down on the post between the upper end and the enlarged base;

a cord having a first end that Passes through the upper end of the post and exits out of the post adjacent to the enlarged base to be attached to either the weighted base of the handle or to the enlarged base of the post, the cord having a second end adapted to be attached to a ball; and at least two springs, each on opposite sides of the post for attaching the top end of the handle to the upper end of the post, wherein gripping the outer surface of the handle allows a trainer to flick the handle along the post so that the weight impacts another surface causing a shockwave that travels down the cord to the attached ball.

7. The training tool of claim 6, wherein the weighted end of the sliding handle includes: a lower surface with a recess portion for crimping a portion of the cord when the weighted end of the sliding handle strikes the impact surface of the enlarged base of the post.

8. The training tool of claim 6, wherein the impact surface of the enlarged base includes: an impact surface with a recess portion for crimping a portion of the cord when the weighted end of the sliding handle strikes the impact surface of the enlarged base of the post.

9. A training tool for reducing ball fumbling, comprising:

a tube having an enlarged upper end with an upper stop having an upper impact surface contiguous about the upper end, and an enlarged bottom end with a bottom stop having bottom impact surface contiguous about the bottom end;

a slidable reciprocating weight on the tube located between the upper end and the bottom end, the slidable weight having an exterior surface to form a single handle surface, the weight having an upper position for directly and only impacting against the upper impact surface, and the slidable weight having a bottom position for directly and only impacting against the bottom impact surface;

a cord having a first end attached to the enlarged upper end of the tube, and a second end; and a ball attached to the second end of the cord, wherein only the exterior surface of the slidable weight is adapted to be held has a single handle in a single hand of a first person in a substantially vertical orientation, and the ball is adapted to he carried by a second person with the cord being taught therebetween, so that the first person pumping the slidable weight causes the reciprocating weight to impact directly and only against at least one of the upper impact surface and the bottom impact surface, causing shockwave(s) (pressure pulse(s)) to transmit down the cord to the ball, in order to attempt to jar and cause the second player to fumble the carried ball.

10. The training tool of claim 1, wherein the lower end of the post has an exterior threaded surface, and the stop is a nut with a threaded opening therethrough to be threaded onto the threaded surface.

11. The training tool of claim 10, wherein the nut includes a flanged nut.

12. The training tool of claim 9, wherein the upper end and the lower end of the tube each includes an exterior threaded surface, and the upper stop and the lower stop each include a nut threaded about each threaded surface.

13. The training tool of claim 12, wherein each nut includes a flanged nut.

* * * * *